United States Patent [19]

Hundebol

[11] Patent Number: 4,518,452

[45] Date of Patent: May 21, 1985

[54] METHOD FOR PRODUCING A GRINDING- OR POLISHING DISC AND A MACHINE FOR THIS PURPOSE

[76] Inventor: Keld O. Hundebol, Kanalvej 22, Ansager, Denmark, 6823

[21] Appl. No.: 395,001

[22] PCT Filed: Nov. 20, 1981

[86] PCT No.: PCT/DK81/00104

§ 371 Date: Jun. 30, 1982

§ 102(e) Date: Jun. 30, 1982

[87] PCT Pub. No.: WO82/01845

PCT Pub. Date: Jun. 10, 1982

[30] Foreign Application Priority Data

Nov. 24, 1980 [DK] Denmark ..... 4998/80

[51] Int. Cl.[3] ..... B31F 3/00

[52] U.S. Cl. ..... 156/211; 156/227; 156/257; 15/181; 15/199; 15/DIG. 3; 51/293

[58] Field of Search ..... 51/395, 404, 376–378, 51/400, 330–337, 397, 182, 293; 15/197, 198, 213, 182, 181, 199, DIG. 3; 156/256, 257, 260, 275.1, 275.3, 275.5, 322, 295, 308.4, 323, 227, 211

[56] References Cited

U.S. PATENT DOCUMENTS

| | | | |
|---|---|---|---|
| 349,727 | 9/1886 | Luddy | 15/182 |
| 1,152,180 | 8/1915 | Jarvis | 15/182 |
| 2,024,691 | 12/1935 | Kent | 51/397 |
| 2,294,480 | 9/1942 | Rohweder | 300/21 |
| 2,698,783 | 1/1955 | Jones | 51/293 |
| 2,879,631 | 3/1959 | Peterson | 51/397 |
| 2,984,598 | 5/1961 | Gobalet | 156/322 |
| 3,120,724 | 2/1964 | Mockiewicz | 51/397 |
| 3,134,703 | 5/1964 | Listner | 156/308.4 |
| 3,727,353 | 4/1973 | Pixley | 51/376 |
| 3,971,688 | 7/1976 | Abbott | 156/295 |

*Primary Examiner*—George F. Lesmes
*Assistant Examiner*—William M. Atkinson
*Attorney, Agent, or Firm*—Burgess, Ryan & Wayne

[57] ABSTRACT

A grinding- or polishing implement can be produced by providing a rectangular sheet (1) at both sides with segments (2) formed by slits from the outside towards the center. Hereafter the sheet is folded around the center across a glue string (5), and then the two folding edges are folded together and glued together for the formation of a closed ring. This ring can thereafter be placed on a spindle (6) preferably between retaining discs (8).

In this way raw material can be saved in the production of rings, just as the rings can be used more economically in an implement as the grinding qualities are improved through the big number of segments, their completely uniform size and placing along the periphery of the implement and their ability to adjust and shape themselves according to the prepared members.

An implement can be produced by disposing such rings between retaining discs (8) on a rotating spindle (6), and in order to secure the rings the spindle (6) can at its end have one or more guide facings (10), in which a co-operating guide pin (12) on a disc (7) can slide and be axially displaced by being tightened together with a bolt (11).

2 Claims, 5 Drawing Figures

Figure 1:
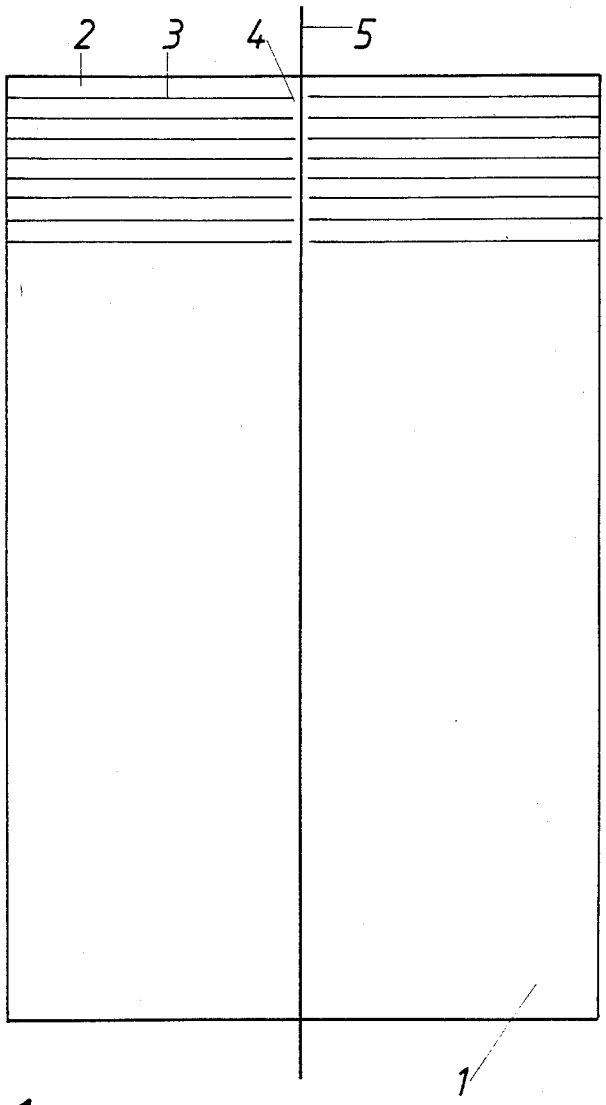

METHOD FOR PRODUCING A GRINDING- OR POLISHING DISC AND A MACHINE FOR THIS PURPOSE

The invention relates to a method for producing a grinding- or polishing disc in which the grinding members are flexible, and to a grinding- or polishing machine for this purpose.

Grinding- or polishing discs are used as rotating implements of different kinds. Usually the abrasive active medium is provided with abrasive grits, but non-abrasive mediums are also used for removing e.g. surface coatings such as rust or the like.

Hitherto known discs of this kind are produced by way of some kind of fastening of the abrasive medium to a carrier in the shape of a solid of revolution. It can be glued on or by mechanical means be fastened to the carrier.

Such discs are difficult to produce as they must have a uniform grinding surface and, if replacement of destroyed or worn members is desired, also be provided with means which admit a replacement of the components. Moreover the materials consumption is very large as the single components must be produced separately and thereafter be assembled.

It is the object of this invention to meet these defects and indicate an improved method for the production of such discs. This is achieved by making a number of parrallel cuts through a rectangular sheet from the opposite lateral edges into a point short of the longitudinal centre line, for the formation of a number of segments, whereafter the sheet is folded up around the centre and then bent and joined together with the central portion of one end against the central portion of the opposite end for the formation of a closed ring. By using this method it is achieved in a hitherto unknown and simple way to produce a ring with grinding- or polishing segments regularly disposed along the whole periphery of the ring, which segments all represent a portion of the closed ring formed from one single sheet. The formation of the grinding segments is done by a slit of the two sides of the sheet from the basic material, and the ring is formed by folding this sheet in the first place around the centre and then folding it for the formation of the closed ring. This ring member can now be assembled either alone or together with adjacent rings for the formation of an implement. By using this method there is thus achieved a saving of materials of at least 35 percent achieved in relation to a punching of a corresponding ring in one single sheet, at the same time as the number of segments is doubled, as the ring according to the invention gets two segments on top of each other. Thus the number of rings on an implement can be considerably reduced as the grinding capability is thereby considerably increased. At the same time a completely exact arrangement of the single grinding segments with the same length and characteristics is achieved in a simple way. This results in the wanted regular grinding capability which can usually only be achieved by an extensive after-treatment of the implement. Moreover the method secures that the grinding segments can rotate around their longitudinal axis, as the method secures that the single segments are placed at a suitable distance to the adjacent segments. This means that the implement becomes self-regulating, as the segments will adjust themselves to the prepared member. If the member is even the segments rotate about 90° and grind completely evenly, while they in case of a profiled member will adjust themselves to this by rotating more or less. The grinding effect is thus adjusted to the shape and nature of the surface.

By inserting an adhesive bead along the folding line in the centre and then, if necessary, activating it, the joints can be easily secured. This bead can e.g. consist of a hot melt adhesive material, or, in case of a metal sheet, a fitted soldering material could be used.

The rings are assembled for use by mounting them in retaining discs with the folded edge pinched between adjacent discs, and mounting the discs on a rotatable spindle. This assembly grinds completely evenly, and besides is simple to take apart and assemble.

In order to be able to quickly tighten the assembly and retain the rings in a safe way, the spindle is provided with one or more peripheral guide facings and a central tapped hole. An outer disc with one or more guide pins that mate with the facings is applied over the spindle and a bolt is screwed into the tapped hole.

Figure 2:
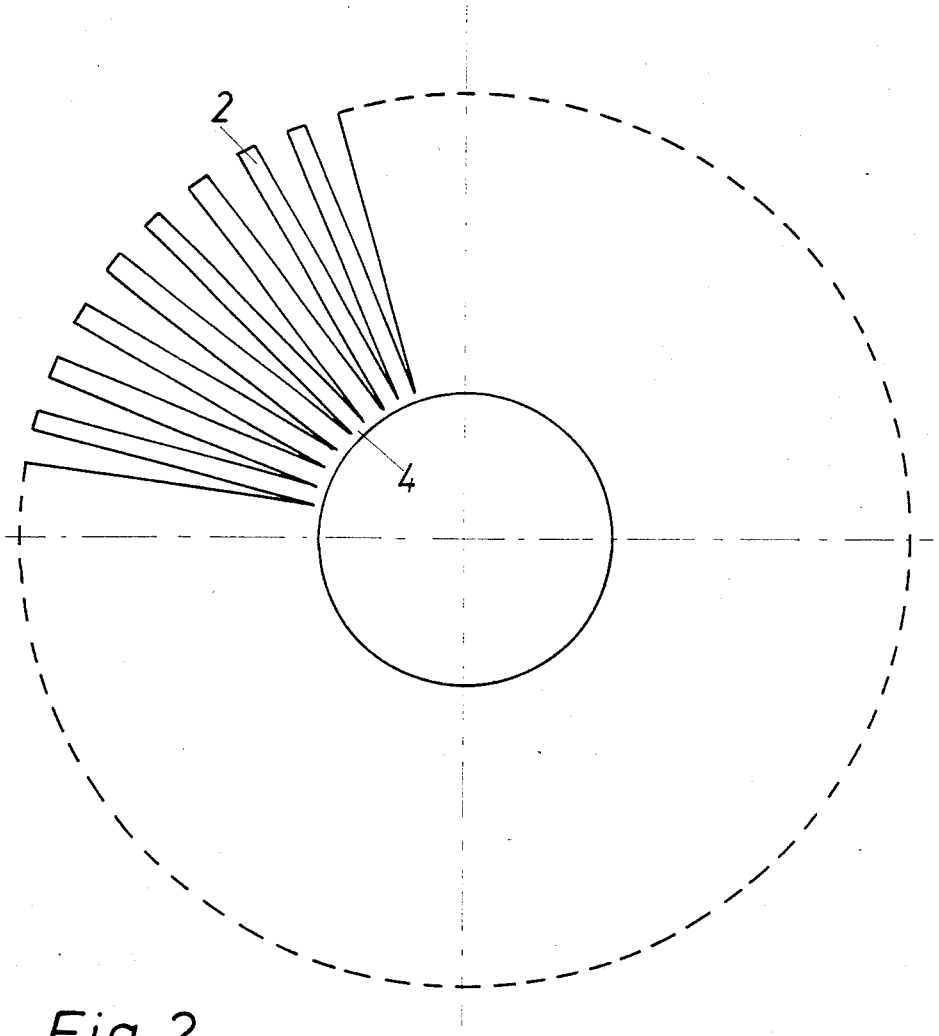
Figure 3:
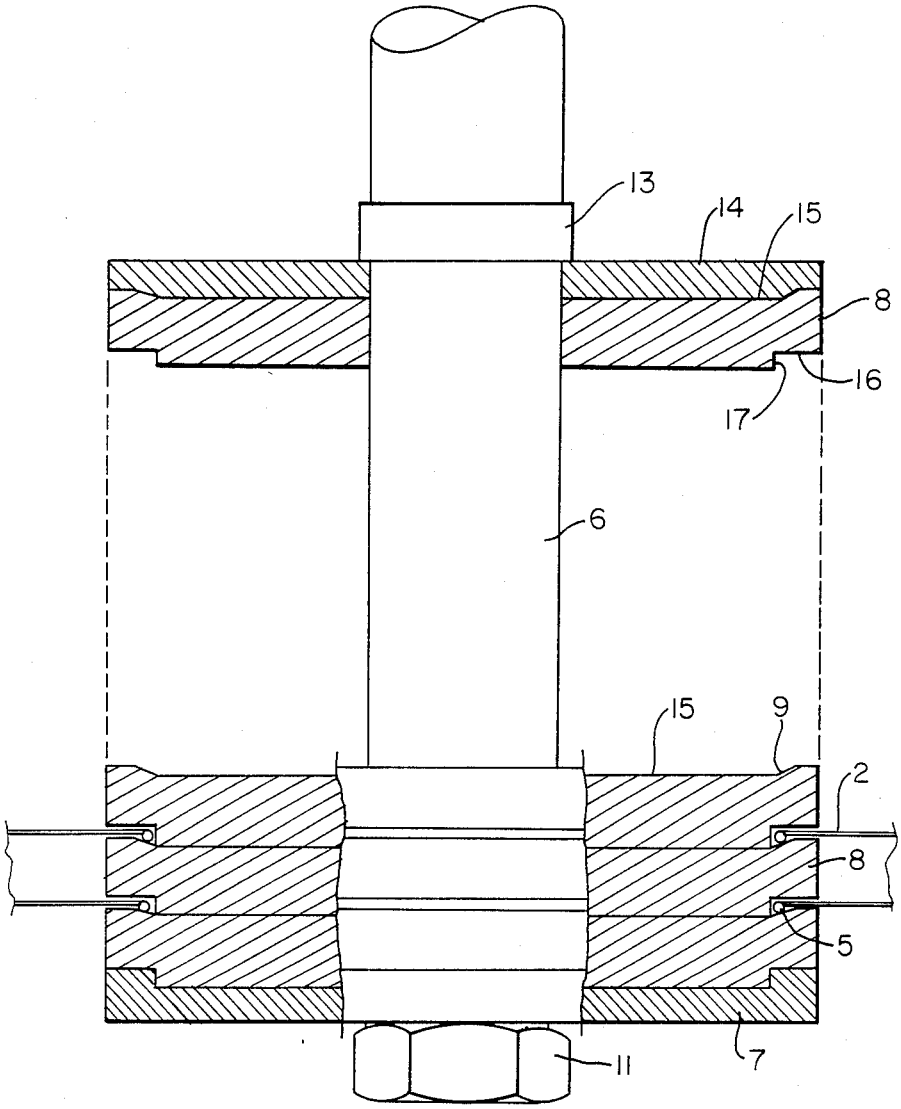
Figure 4:
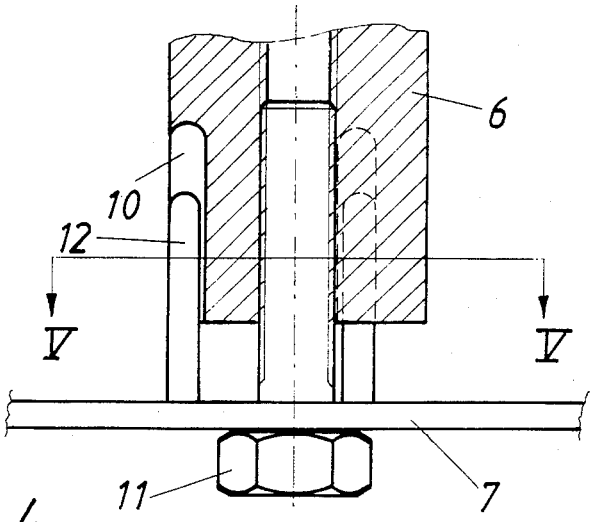
Figure 5:
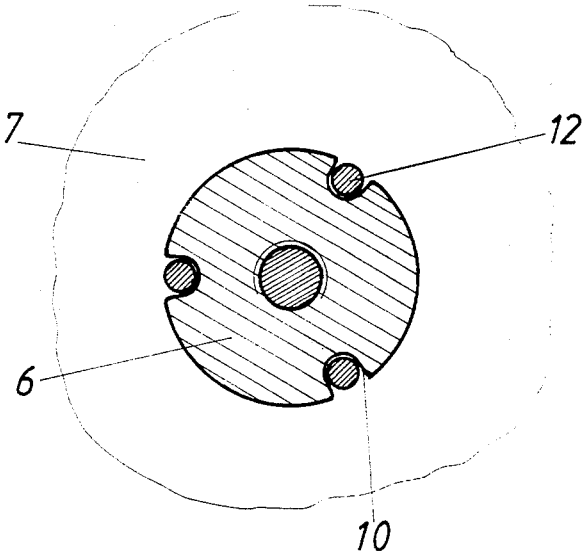

The invention will now be elucidated further in detail with reference to the annexed drawing in which FIG. 1 is a partially schematic plan view of a sheet after the segments have been punched, FIG. 2 is a partially schematic plan view of the sheet after the ring has been formed, FIG. 3 is a side view, partially in cross-section of an assembly comprising a spindle with rings and discs, FIG. 4 is a side view, partially in cross-section of the lower part of the spindle shown in FIG. 3., on an enlarged scale, and FIG. 5 is a sectional view of the spindle taken along the line V—V in FIG. 4.

As shown in FIG. 1 the starting material is a rectangular sheet 1, which can be of an abrasive kind, e.g. emery cloth, or of a non-abrasive kind, e.g. plastic, skin or metal.

The sheet is provided with parallel slits 3, at both sides of the centre line at its full length whereby segments 2 appear at both sides of the longitudinal centre line and leave a central longitudinal area 4. The segments have the same length and the same width. Then a bead 5 is inserted in the centre along the length of the sheet. The bead can, where the sheet can be glued together, be of e.g. a hot melt material. In case of metal, the bead can e.g., be of a soldering material.

The sheet is now folded together around the centre so that the segments 2 lie on top of each other. Thereafter the ends of the folding edge are put against each other so that the bead 5 is assembled for the formation of a closed ring as shown in FIG. 2.

The bead is melted by means of heat, and the ring is ready. Instead of a bead a closed ring, around which the sheet is folded, could be used.

In FIG. 3 the rings are shown placed on a spindle 6 for the formation of the assembly. On the spindle there is a stop 13 on which a disc 14 is mounted. Against this a retaining disc 8 of e.g. plastic is placed. The disc 8 is at its top side provided with a cavity 15 and at its under side with a peripheral slot 16. The shape is clearly seen in cross section in FIG. 3. Besides there is a sloping edge 9 from the cavity 15 to the surface and a shoulder 17 from the surfaces to the slot 16.

In FIGS. 4 and 5 the lower portion of the spindle 6 is shown. At the centre it is provided with a tapped hole in which a bolt 11 can be screwed. At the periphery of the spindle three guide facings 10 are placed, in which corresponding pins 12 disposed on a disc 7 can be axially displaced. When the bolt is tightened together an axial displacement of the disc takes place and with it a pinching together of discs and rings disposed in layers on the spindle. The guide pins secure the disc 7 against rotation in relation to the spindle, by means of which the bolt 11 is locked to the spindle. This secures that the bolt does not unscrew itself during operation of the assembly and so does not slacken the single rings and discs.

When constructing the assembly a retaining disc 8 and a ring are in turn placed on the spindle. The interior of the ring with binding material and folding edges is held in between the two retaining discs 8 at both sides of the ring. At the bottom a disc 7 and a representative locking device are shown. This can be a bolt or a similar tightening device, by means of which rings and discs can be tightened together so that they are firmly locked to the spindle.

In this way an assembly can be constructed which has flexible segments disposed regularly all over the periphery so a fast, even and exact grinding process can be obtained.

I claim:

1. A method for producing a grinding or polishing disc having flexible grinding members, comprising the steps of:

providing a rectangular sheet of an abrasive material;

making a plurality of parallel transverse cuts from opposite longitudinal edges in toward the longitudinal centre line of said sheet, and terminating said cuts short of said center line, to thereby form a central longitudinal area with a plurality of segments extending outwardly therefrom;

placing a string of a solid, deformable heat-activatable adhesive material along said center line at least for the entire length of said sheet;

folding said sheet around said string of adhesive about said center line;

bending said folded sheet along said center line to form a circle; and joining the end portions of said central area together in abutting relation to form a closed ring by applying heat to said string.

2. A method for producng a grinding or polishing disc having flexible grinding members, comprising the steps of:

providing a rectangular sheet of an abrasive material;

making a plurality of parallel transverse cuts from opposite longitudinal edges in toward the longitudinal center line of said sheets, and terminating said cuts short of said center line, to thereby form a central longitudinal area with a plurality of segments extending outwardly therefrom;

bending said rectangular sheet along said center line to form a circle;

placing a string of solid, deformable heat-activatable adhesive material along said center line at least for the entire length of said sheet;

folding said sheet around said string of adhesive about said center line; and joining the end portions of said central area together in abutting relation to form a closed ring by applying heat to said string.

* * * * *